US010631663B2

(12) United States Patent
McHugh

(10) Patent No.: US 10,631,663 B2
(45) Date of Patent: Apr. 28, 2020

(54) BABY CARRIER COVER

(71) Applicant: Michael Benjamin McHugh, Pointe-Claire (CA)

(72) Inventor: Michael Benjamin McHugh, Pointe-Claire (CA)

( * ) Notice: Subject to any disclaimer, the term of this patent is extended or adjusted under 35 U.S.C. 154(b) by 286 days.

(21) Appl. No.: 15/667,906

(22) Filed: Aug. 3, 2017

(65) Prior Publication Data

US 2018/0078051 A1 Mar. 22, 2018

Related U.S. Application Data

(60) Provisional application No. 62/395,450, filed on Sep. 16, 2016.

(51) Int. Cl.

| | |
|---|---|
| ***A41D 15/00*** | (2006.01) |
| ***A47D 13/02*** | (2006.01) |
| ***A47D 15/00*** | (2006.01) |
| ***A47C 7/66*** | (2006.01) |
| *A41B 13/00* | (2006.01) |
| *A47C 7/00* | (2006.01) |
| *A47D 13/00* | (2006.01) |

(52) U.S. Cl.

CPC ..... *A47D 13/025* (2013.01); *A47C 7/66* (2013.01); *A47D 15/00* (2013.01); *A41B 13/00* (2013.01); *A47C 7/00* (2013.01); *A47D 13/00* (2013.01)

(58) Field of Classification Search

CPC . A41D 15/00; A41D 1/21; A41D 3/02; A41D 2400/482; A47D 13/02

USPC ..... 224/158; 2/69

See application file for complete search history.

(56) References Cited

U.S. PATENT DOCUMENTS

| | | | | |
|---|---|---|---|---|
| 3,997,982 | A * | 12/1976 | Holland | G09B 25/00 434/260 |
| 5,950,887 | A * | 9/1999 | Powell | A47D 13/025 224/158 |
| 6,868,558 | B2 * | 3/2005 | Majerfeld | A41D 27/04 2/96 |
| 10,327,483 | B2 * | 6/2019 | Messier | A41D 15/002 |
| 2008/0256679 | A1 * | 10/2008 | White | A41D 15/00 2/84 |
| 2010/0107300 | A1 * | 5/2010 | Yiu | A41D 15/00 2/85 |
| 2011/0113523 | A1 * | 5/2011 | Lobas | A41D 3/06 2/79 |
| 2014/0189930 | A1 * | 7/2014 | Solomon | A47D 13/025 2/69 |
| 2014/0296045 | A1 * | 10/2014 | Krstanoski-Blazeski | A47D 13/025 482/139 |
| 2015/0201680 | A1 * | 7/2015 | Lee | A41D 1/21 2/93 |

* cited by examiner

*Primary Examiner* — Derek J Battisti

(57) ABSTRACT

A carrier cover positionable over a baby carrier worn by an intended user. The carrier cover includes a jacket attachment for reversibly securing part of a jacket the carrier cover. Also a method of using the carrier cover.

22 Claims, 6 Drawing Sheets

BABY CARRIER COVER

FIELD OF THE INVENTION

The present invention relates to the general field of baby accessories, and is more specifically concerned with a baby carrier cover.

BACKGROUND

Baby carriers are popular for carrying babies close to the person wearing the baby carrier, usually the mother or father of the baby. In cold weather, there is a need to protect the baby from the cold. One popular solution is to simply wear the baby carrier under a jacket, with or without a jacket extender. This causes problems as unzipping the jacket to evacuate heat, for example when walking, causes the baby to be exposed to the cold. Another solution consists in wearing the baby carrier over a jacket and to cover the baby carrier with a warm carrier cover. However, this causes loss of the direct contact between the baby and the person wearing the baby carrier, such contact being one of the reasons to use the baby carrier in the first place.

Accordingly, there exists a need for an improved baby carrier cover. It is a general objective of the present invention to provide such an improved baby carrier cover.

SUMMARY OF THE INVENTION

In a broad aspect, the invention provides a carrier cover securable to a baby carrier to at least partially cover a baby carried in the baby carrier with the baby carrier worn by an intended user, the carrier cover being usable in combination with a jacket worn by the intended user, the jacket having a pair of jacket front portions defining each a respective jacket front portion free edge, the jacket front portion free edges facing each other and defining a jacket gap therebetween, the carrier cover including: a body defining two opposed body side portions and a body front portion extending therebetween, the body front and side portions covering respectively front facing and side facing portions of the baby when the carrier cover is operatively secured to the baby carrier; at least one mounting element for mounting the body to the baby carrier; and at least one jacket attachment extending from the body and attachable to at least one of the jacket front portions at the jacket front portion free edge.

The invention may also provide a carrier cover wherein the jacket includes a jacket closure at the jacket front portion free edge, the jacket attachment being attachable to the jacket closure.

The invention may also provide a carrier cover wherein the jacket closure is a jacket slide fastener including a pair of jacket slide fastener halves each mounted at a respective one of the jacket front portion free edges and a jacket slider operable for selectively engaging the jacket slide fastener halves to each other and disengaging the jacket slide fastener halves from each other, the jacket attachment including an attachment slide fastener half operable for engaging one of the jacket slide fastener halves.

The invention may also provide a carrier cover wherein the jacket closure is a jacket slide fastener including a pair of jacket slide fastener halves each mounted at a respective one of the jacket front portion free edges and a jacket slider operable for selectively engaging the jacket slide fastener halves to each other and disengaging the jacket slide fastener halves from each other, the jacket attachment including a pair of elongated attachment slide fastener halves secured to the body laterally spaced apart from each other and an attachment slider slidable along one of the attachment slide fastener halves, each attachment slide fastener half being attachable to a respective one of the jacket slide fastener halves using one of the jacket and attachment sliders.

The invention may also provide a carrier cover wherein the attachment slide fastener halves each include opposed attachment half top and bottom portions and an attachment half intermediate portion therebetween, the attachment half top portions being spaced apart from each other by a larger distance than the attachment half bottom portions.

The invention may also provide a carrier cover wherein the jacket attachment includes a clip secured to the body, the clip being clippable to the jacket at one of the jacket front portion free edges.

The invention may also provide a carrier cover wherein a substantially elongated clip mounting element extends between the clip and the body.

The invention may also provide a carrier cover wherein the clip mounting element is resiliently stretchable for allowing variations in a distance between the clip and the body when the clip mounting element is stretched.

The invention may also provide a carrier cover wherein the clip mounting element is selectively length adjustable.

The invention may also provide a carrier cover wherein the body defines a body peripheral edge, the mounting element including a drawstring operatively coupled to the body for selectively drawing at least part of the body at the body peripheral edge.

The invention may also provide a carrier cover wherein the drawstring is mounted inside a hem so that the hem is slidable relative thereto along a major portion thereof, the drawstring having two attachment locations secured to the body so that the two attachment locations are fixed relative to the hem, the hem defining a hem aperture through which part of the drawstring protrudes, the mounting element further including a cord lock for selectively locking a length of the drawstring protruding from the drawstring aperture.

The invention may also provide a carrier cover wherein the baby carrier includes a shoulder strap, the mounting element including a mounting strap securable to one of the shoulder straps.

The invention may also provide a carrier cover further including a hood portion extending from the body for covering a head of the baby.

The invention may also provide a carrier cover wherein the hood portion is removably attachable to the body.

The invention may also provide a carrier cover further including a waist strap extending from the body for selectively encircling a waist of the intended user.

The invention may also provide a carrier cover wherein the body defines a body bottom portion covering a bottom facing portion of the baby when the carrier cover is operatively secured to the baby carrier.

The invention may also provide a carrier cover wherein the jacket attachment is selectively securable to the body at a selected one of at least two different locations on the body.

In another broad aspect, the invention provides, In combination, a carrier cover and a baby carrier, the carrier cover being positioned over the baby carrier so as to least partially cover a baby carried in the baby carrier with the baby carrier worn by an intended user, the carrier cover being usable in combination with a jacket worn by the intended user, the jacket having a pair of jacket front portions defining each a respective jacket front portion free edge, the jacket front portion free edges facing each other and defining a jacket gap therebetween, the carrier cover including: a body defining two opposed body side portions and a body front portion extending therebetween, the body front and side portions covering respectively front facing and side facing portions of the baby when the carrier cover is operatively secured to the baby carrier; at least one mounting element for mounting the body to at least one of the baby carrier and the intended user; and at least one jacket attachment extending from the body and attachable to at least one of the jacket front portions at the jacket front portion free edge.

In yet another broad aspect, the invention provides a method performed by an intended user wearing a jacket and a baby carrier in which a baby is carried adjacent a chest of the intended user, the jacket being worn over the baby carrier and the baby, the jacket having a pair of jacket front portions defining each a respective jacket front portion free edge, the jacket front portion free edges facing each other, the method using a carrier cover, the method including: securing the carrier cover over the baby carrier; and securing each jacket front portion at the jacket front portion free edge to the carrier cover so that carrier cover closes the jacket and the intended user and the baby are protected from the elements jointly by the jacket and the carrier cover.

The invention may also provide a method further including detaching at least one of the jacket front portions from the carrier cover so that the intended user is exposed to ambient air while the baby is protected from ambient air by the carrier cover.

Advantageously, the proposed carrier cover decouples protection of the baby by the carrier cover from protection by the jacket of the person wearing the baby carrier. Thus, the person wearing the baby carrier can open one or both jacket sides by detaching them from the jacket attachment to regulate his temperature without exposing the baby directly to cold temperature. Also, in some embodiments, the same carrier cover is usable with a wide variety of jacket and/or baby carrier types.

The contents of U.S. Provisional Patent Application 62/395,450 filed 2016 Sep. 16, and from which the present application claims benefit from, is hereby incorporated by reference in its entirety.

Other objects, advantages and features of the present invention will become more apparent upon reading of the following non-restrictive description of preferred embodiments thereof, given by way of example only with reference to the accompanying drawings.

DETAILED DESCRIPTION

The term "substantially" is used throughout this document to indicate variations in the thus qualified terms. These variations are variations that do not materially affect the manner in which the invention works and can be due, for example, to uncertainty in manufacturing processes or to small deviations from a nominal value that do not cause significant changes to the invention. These variations are to be interpreted from the point of view of the person skilled in the art. Also, directional terminology such as front, top and side, refer to a person standing up and wearing the proposed carrier cover over a baby carrier in which a baby is carried, the location of the person where the baby is carried being referred to as "front". This terminology is used for convenience purpose and should not be interpreted to restrict the scope of the claimed invention.

Figure 1:
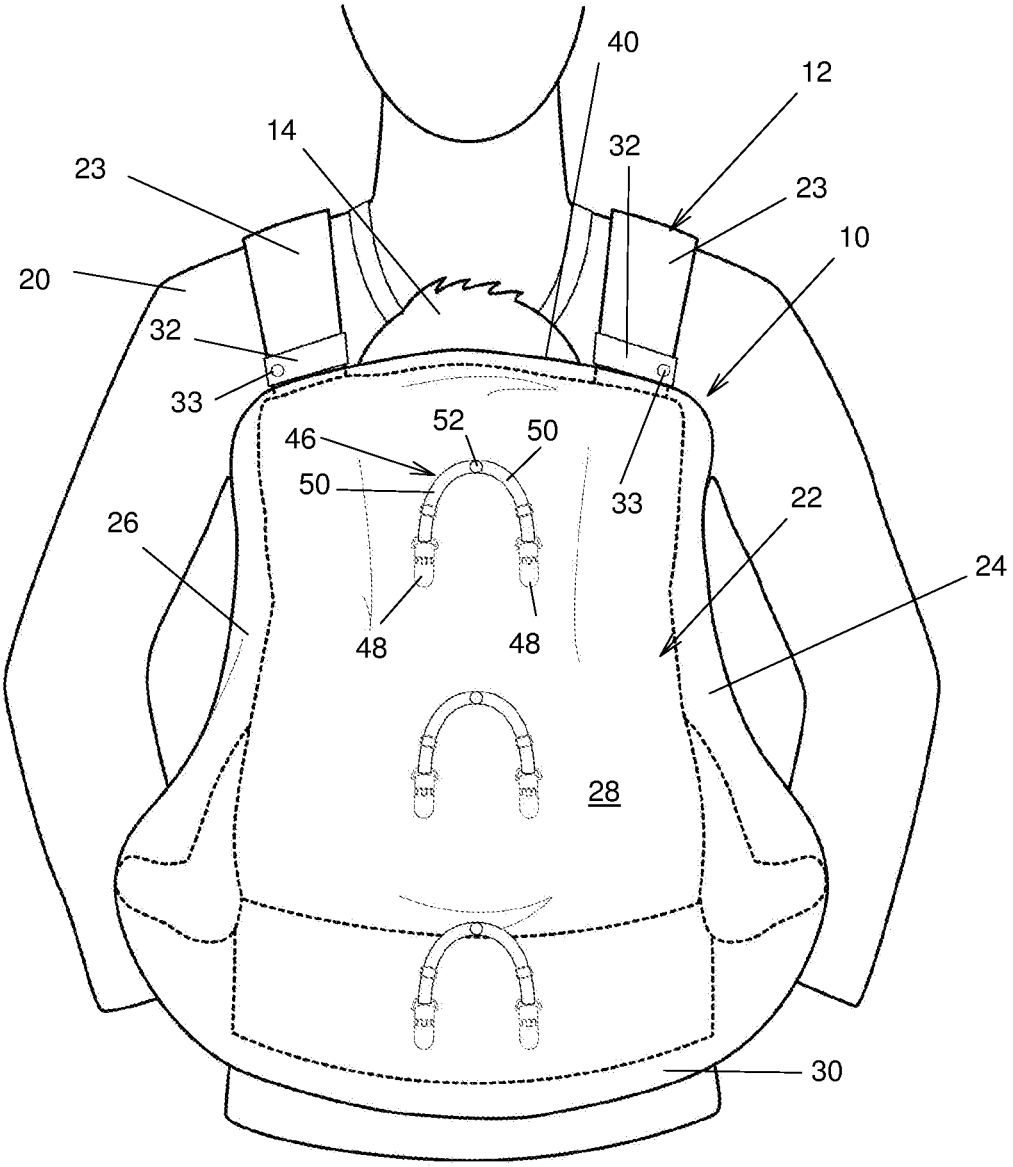
FIG. 1, in a front elevation view, illustrates a carrier cover in accordance with an embodiment of the present invention, the carrier cover being shown secured to a baby carrier worn by an intended user, a baby being carried in the baby carrier.

Referring for example to FIG. 1, there is shown a carrier cover 10 in accordance with an embodiment of the present invention. The carrier cover 10 is securable to a baby carrier 12 to at least partially cover a baby 14 (seen only partially in FIG. 1) carried in the baby carrier 12 with the baby carrier 12 worn by an intended user 20. The terminology "at least partially cover" is to be understood to signify that at least part of the carrier cover 10 is positioned such that ambient air cannot reach directly the baby 14 or the baby carrier 12 through the covered portion, so as to protect the baby from at least one of cold air, wind, and precipitations, for example in the form of rain, snow or hail, among other possibilities.

Figure 3:
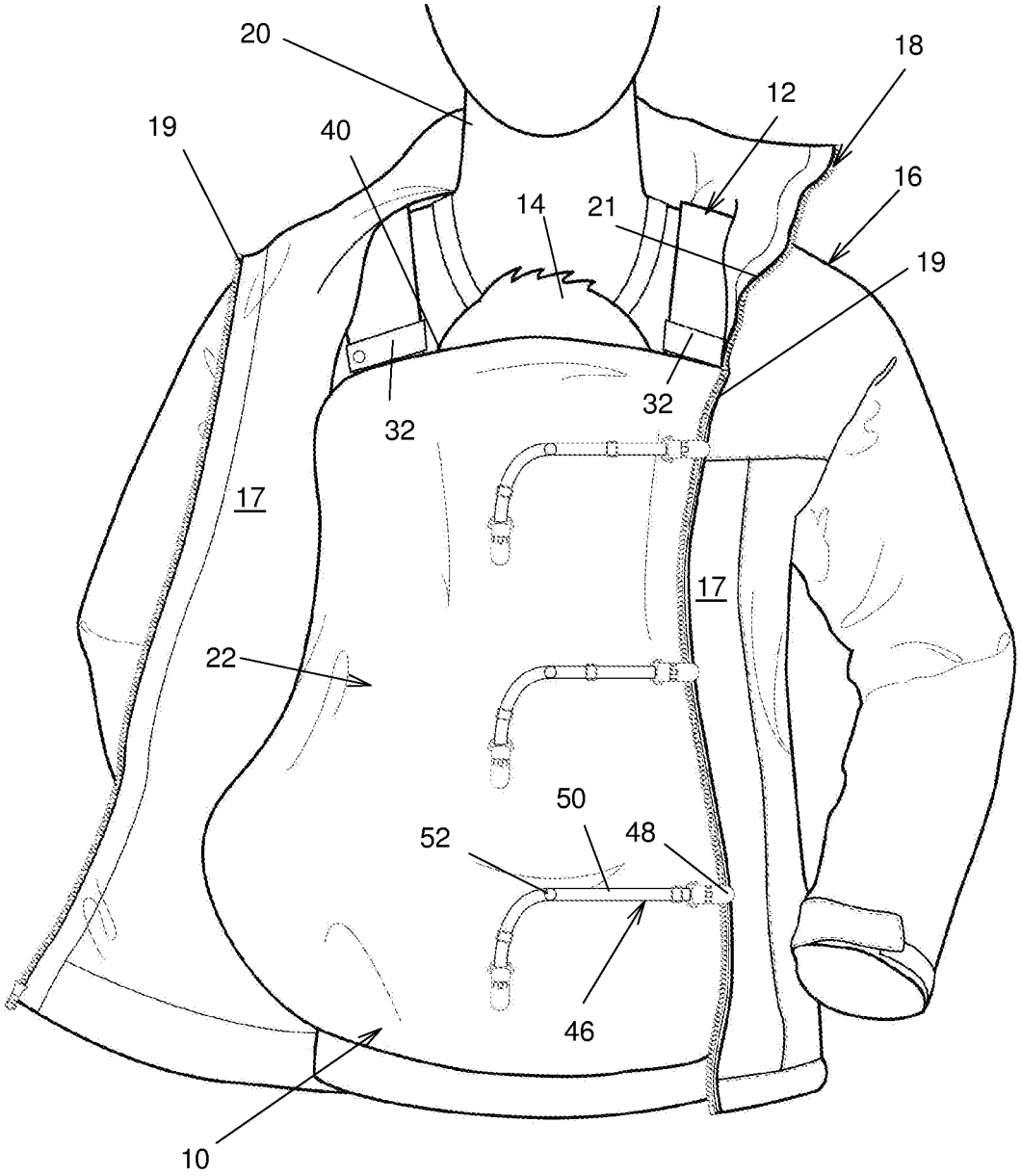
FIG. 3, in a front elevation, illustrates the carrier cover of FIGS. 1 and 2, the carrier cover having secured thereto one front panel of a jacket worn by the intended user.

The carrier cover 10 is usable in combination with a jacket 16 (seen for example in FIG. 3) worn by the intended user 20. For the purpose of this document, a jacket 16 is any garment worn over interior clothes and used typically outside to protect the intended user from cold, rain, snow and other meteorological phenomena. The jacket 16 may me a traditional leather or synthetic material jacket, but may also take the form of a cardigan or of a hoodie opening with a zipper at the front, among other possibilities. The jacket 16 has a pair of jacket front portions 17 defining each a respective jacket front portion free edge 19, the jacket front portion free edges 19 facing each other and defining a jacket gap 21 therebetween. The jacket 16 typically has a jacket closure 18 provided at the jacket front portion free edges 19 for selectively opening and closing the jacket 16 at its front. The jacket front portions 17 together form the front of the jacket 16, the latter being openable or closable using the jacket closure 18.

Figure 2:
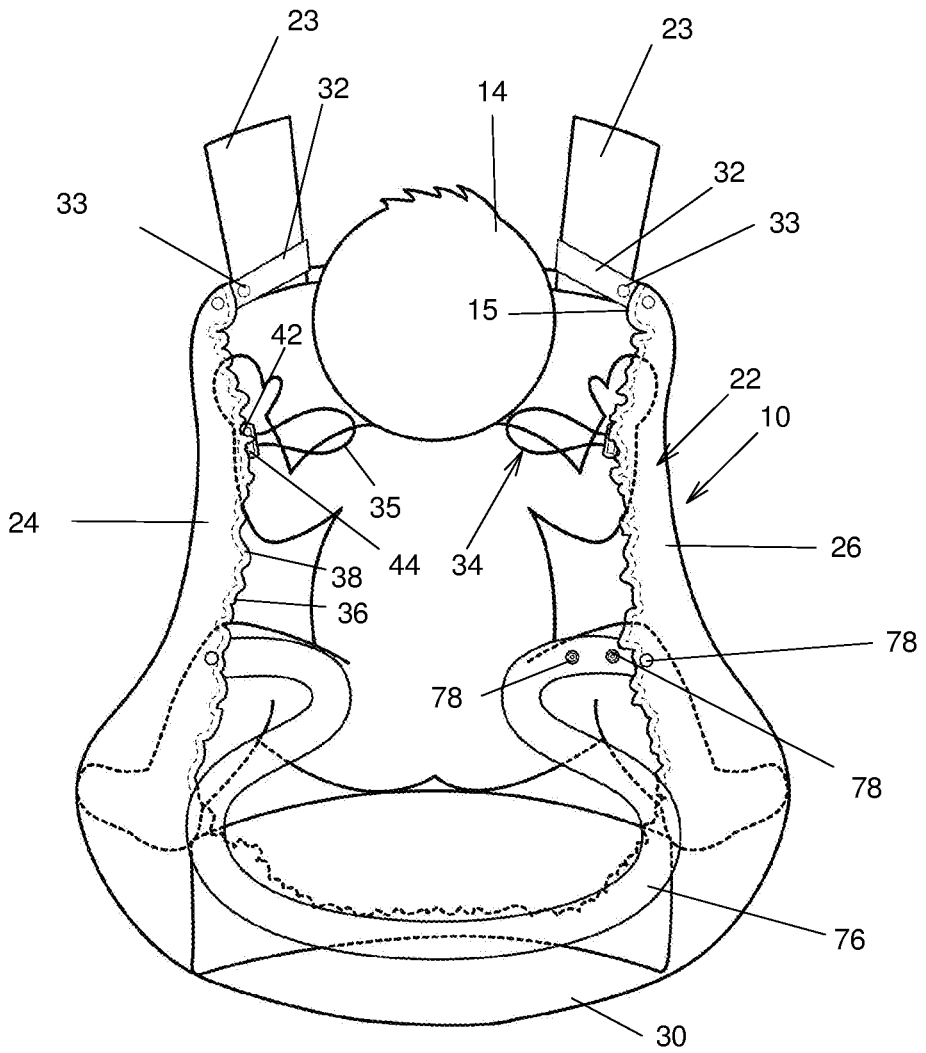
FIG. 2, in a rear elevation view, illustrates the carrier cover and baby carrier of FIG. 1 in a configuration wherein the baby carrier is worn by the intended user, the latter being omitted from FIG. 2.

Returning to FIG. 1, the carrier cover 10 includes a body 22 defining two body side portions 24 and 26 and a body front portion 28 extending therebetween. The body front and side portions 28, 24 and 26 protect respectively the front facing and side facing portions of the baby 14 when the carrier cover 10 is operatively secured to the baby carrier 12. The body 22 typically includes one or more panels of fabric, and in some embodiments, includes a heat insulating material. Typically, the body 22 also includes a body bottom portion 30 extending from the body front portion 28 and protecting the bottom facing portion of the baby 14 when the carrier cover 10 is operatively secured to the baby carrier 12. The body side, front and bottom portions 24, 26, 28 and 30 can extend integrally from each other or can be made of different elements sewed, glued or otherwise secured to each other, and may be made of one single material or of different materials. With reference to FIG. 2, it should be noted that typically, but not necessarily, part of the body side and bottom portions 24, 26 and 30 that is opposed to the body front portion 28 may reach slightly at the rear of the baby carrier 12 to better enclose the baby 14 in the body 22.

At least one mounting element is provided for mounting the body 22 to the baby carrier 12. In the specific embodiment of the invention, three mounting elements are provided in the form of two mounting straps 32 and a drawstring 34, but other conventional mounting elements are within the scope of the invention.

More specifically, the mounting straps 32 are provided at the top of the body side portions 24 and 26 and include fasteners 33, such as conventional snap buttons, among other possibilities, for forming a closed loop in each of the mounting straps 32. Such mounting straps 32 are typically looped around a suitable structure of the baby carrier 12, for example shoulder straps 23, to attach the carrier cover 10 to the baby carrier 12.

The drawstring 34, is of a conventional type including a length of cord provided at the body peripheral edge 36, for example along the periphery of the body side and bottom portions 24, 26 and 30. The drawstring 34 is operatively coupled to the body 22 for selectively drawing at least part of the body 22 at the body peripheral edge 36. This action results in foreshortening of the body peripheral edge 36, which tightens the body 22 around the baby 14 and baby carrier 12.

For example, the drawstring 34 is mounted inside a hem 38 so that the hem 38 is slidable relative thereto along most of its length. The drawstring 34 has two attachment locations secured to the body 22, so that the two attachment locations are fixed relative to the hem 38. For example the drawstring 34 has its ends secured at the top of the body 22, on each side thereof, and the hem 38 extends along the whole body side and bottom portions 24, 26 and 30, leaving only the top edge 40 of the body 22 free from the drawstring 34. The hem 38 defines at least one hem aperture 42 through which part of the drawstring 34 protrudes, forming a loop 35. The mounting element further including a cord lock 44 for selectively locking a length of the drawstring 34 protruding from the hem aperture 42. In the carrier cover 10, two hem apertures 42 and two cord locks 44 are provided, each on a respective side of the body 22. It should be noted that any other suitable drawstring may be used. For example and non-limitingly, drawstrings extending through a tube or laced through holes or loops provided at the periphery of the body 22 are also within the scope of the invention.

Varying the size of the loop(s) 35 allows tightening and loosening the body 22 around the baby carrier 12. When the carrier cover 10 is mounted to the baby carrier 12, the baby 14 is enclosed in the carrier cover 10, except for a top opening, defined by the top edge 40, allowing air to reach the baby for breathing, and a rear gap 15 which faces the intended user 20 and is thus not exposed to ambient cold air.

Returning to FIG. 3, the carrier cover 10 includes at least one jacket attachment 46 extending from the body 22 and attachable to at least one of the jacket front portions 17 at the jacket front portion free edge 19. For example, the jacket attachment 46 includes a clip 48 secured to the body 22, the clip 48 being clippable to the jacket 16 at one of the jacket front portion free edges 19.

A clip 48 is any device that can grip the jacket 16 and hold the latter so that the baby carrier 12 and the jacket 16 are reversibly attached to each other and will not detach from each other spontaneously during regular activities. Typically, such clips 48 will include two jaws that can be selectively opened and which are biased towards each other in a closed configuration. However, unbiased clips that include a mechanism that locks the jaws in a closed configuration are within the scope of the invention.

Typically, a substantially elongated clip mounting element 50 extends between the clip 48 and the body 22, and is secured to the body 22 either permanently, such as through an adhesive, stitches or a rivet, among other possibilities, or removably secured to the body 22, using for example a snap button 52. In such embodiments, the jacket attachment 46 is selectively securable to the body 22 at at least two different locations on the body. The number of such locations where the jacket attachment 46 may be secured may be larger than the number of jacket attachments 46 so that the exact configuration of the jacket attachments 46 can be customized to the morphology of the intended user, dimension of the baby 14 and baby carrier 12, and to the cut and size of the jacket 16. The clip mounting element 50 is typically short enough that the jacket 16 is tightly maintained against the carrier cover 10 when the clip is operatively secured to the jacket 16 to minimize air flow inside the jacket 16 from the jacket front portion free edge 19.

In some embodiments, the clip mounting element 50 is resiliently stretchable for allowing variations in a distance between the clip 48 and the body 22 when the clip mounting element 50 is stretched. Typically, the length of such a stretchable clip mounting element 50 is such that some stretching is required to attach the clip 48 to the jacket 16 to ensure that the latter is tightly maintained against the carrier cover 10.

In some embodiments, the clip mounting element 50 is selectively length adjustable, whether it is stretchable or not. For example, the clip mounting element 50 is similar to the commonly used shoulder bra straps that include a slider slidable along a strap to shorten and lengthen a length of a loop formed in the strap, thereby adjusting the length of the strap.

Referring to FIG. 1, in a typical embodiment, the clips 48 are provided pairwise at various heights along the body 22. For example, a pair of clips 48 is provided adjacent the body top edge 40, another pair of clips 48 is provided adjacent the body bottom portion 30, and yet another pair of clips 48 is provided therebetween. Any suitable number of pairs of clips 48 may be provided, and, in some embodiments, the clips 48 may not be provided pairwise. The clip mounting elements 50 to which the clips 48 within each pair of clips 48 are secured typically meet in the middle of the body 22 for symmetry reasons, and may in some embodiments extend integrally from each other.

Figure 5:
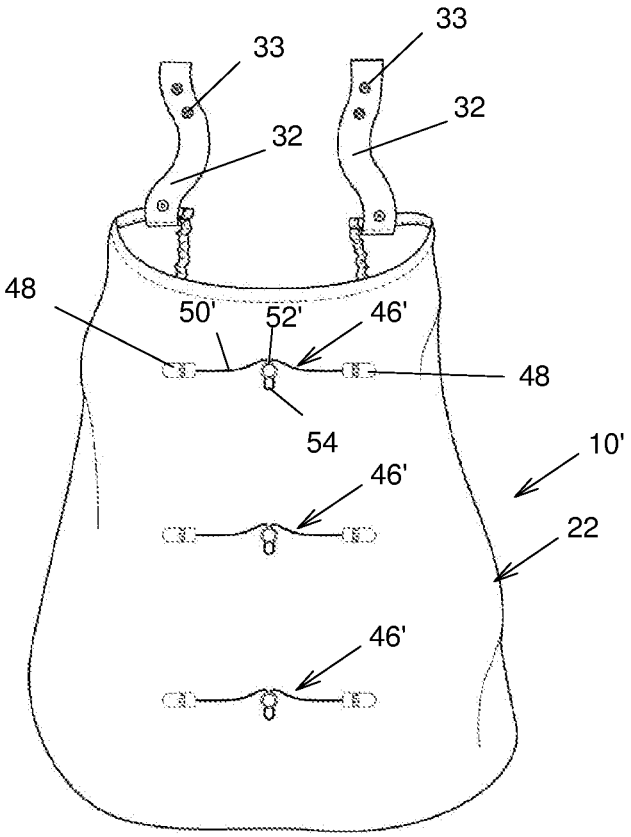
FIG. 5, in a front elevation view, illustrates a carrier cover in accordance with an alternative embodiment of the present invention.

In another exemplary embodiment, seen in FIG. 5, the carrier cover 10' includes an alternative clip mounting element 50' in the form of a stretchable or non-stretchable string that engages a cord stop 52' provided between the two clips 48 attached to the clip mounting element 50'. The cord stop 52' is secured to the body 22. The clip mounting element 50' forms a loop 54 through the cord stop 52', thereby allowing adjustment of the length of the clip mounting element 50' by lengthening or shortening the loop 54.

Figure 6:
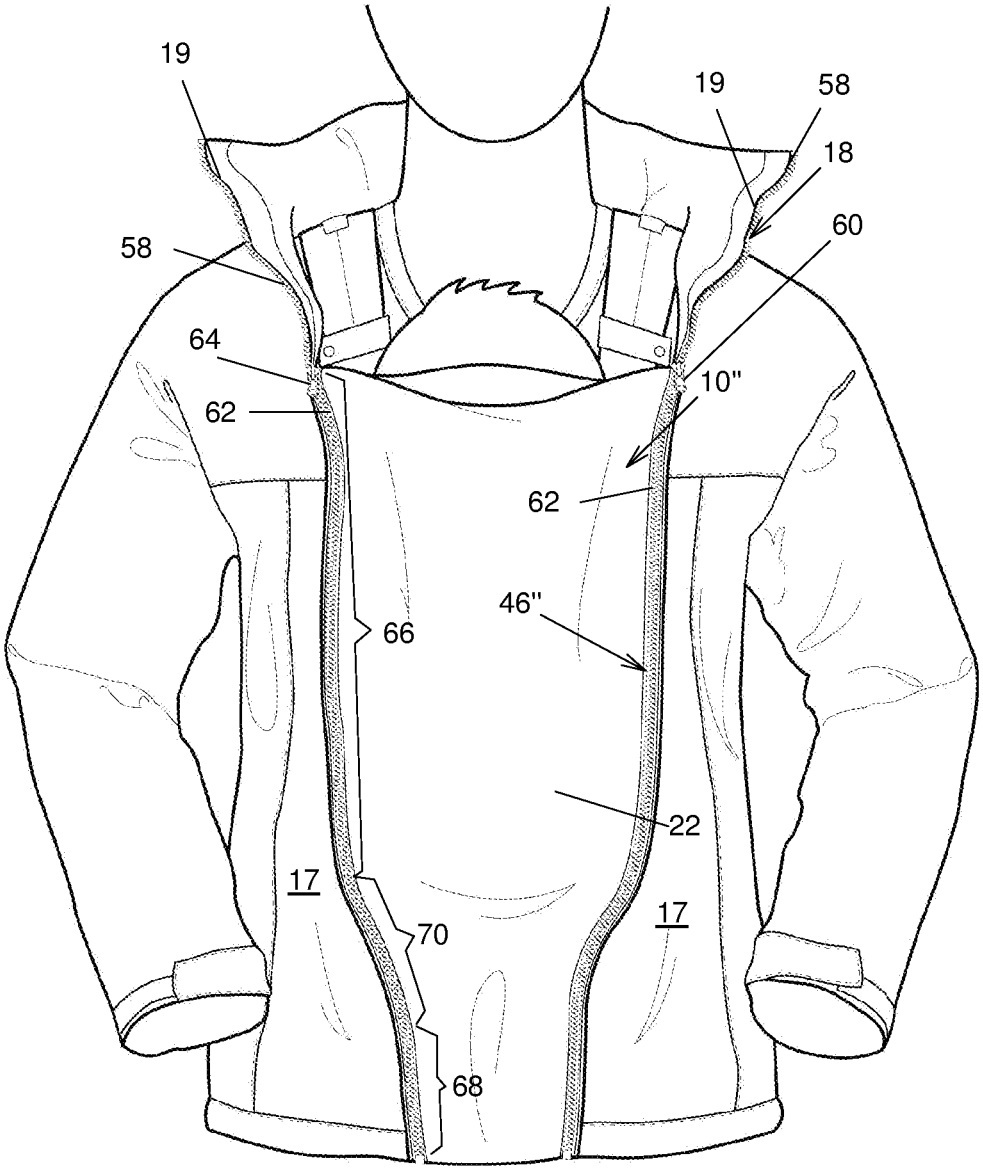
FIG. 6, in a front elevation view, illustrates a carrier cover in accordance with an other alternative embodiment of the present invention.

In yet other embodiments, as in the carrier cover 10" of FIG. 6, the jacket 16 includes the jacket closure 18 at the jacket front portion free edge 19, the jacket attachment 46" being attachable to the jacket closure 18. For example (not shown in the drawings), the jacket closure 18 may include buttons, snap-buttons, or patches of miniature hook and loop material (Velcro™), and the jacket attachment 46" includes complementary buttons, snap-buttons, or patches of miniature hook and loop material respectively.

In the embodiment of the invention shown in the drawings, the jacket closure 18 is a jacket slide fastener, also known as a zipper, including a pair of jacket slide fastener halves 58 each mounted at a respective one of the jacket front portion free edges 19 and a jacket slider 60 operable for selectively engaging the jacket slide fastener halves 58 to each other and disengaging the jacket slide fastener halves 58 from each other. The jacket attachment 46" includes at least one, and typically two, elongated attachment slide fastener halves 62 operable for engaging one of the jacket slide fastener halves 58. When two attachment slide fastener halves 62 are provided, they are typically secured to the body 22 laterally spaced apart from each other.

An attachment slider 64 is slidable along one of the attachment slide fastener halves 62, each attachment slide fastener half 62 being attachable to a respective one of the jacket slide fastener halves 58 using one of the jacket and attachment sliders 60 and 64. In this embodiment, the jacket 16 attaches to the carrier cover 10" to close the jacket 16, along with the carrier cover 10", in the same manner that the jacket 16 would be closed in the absence of the carrier cover 10". The jacket attachments 46" extend from the body front portion 28, but jacket attachments 46" extending from the body side portions 24 and 26 are also within the scope of the invention.

In some embodiments, the attachment slide fastener halves 62 each include opposed attachment half top and bottom portions 66 and 68 and an attachment half intermediate portion 70 therebetween. The attachment half top portions 66 are spaced apart from each other by a larger distance than the attachment half bottom portions 68. The attachment half intermediate portion 70 ensures a smooth transition between these two different spacing. This configuration is useful to leave enough space in the jacket 16 at the top to accommodate the baby 14, while allowing the jacket 16 to be relatively close to the body of the intended user 20 at the bottom to prevent influx of cold air.

For example, and non-limitingly, the jacket closure 18 is a conventional slide fastener including a pair of stringer tapes supporting each a row of teeth extending longitudinally therealong and the jacket slider 60 movable along the stringer tapes in a reciprocating movement for selectively attaching the teeth of both rows to each other when moved in a closing direction and selectively detaching the teeth of both rows from each other when moved in an opening direction opposed to the closing direction. In such embodiments, the jacket attachments 46" may also take the form of stringer tapes supporting teeth and sewed, glued or otherwise secured to the body 22. The jacket attachment 46" then also includes the attachment slider 64. The teeth of the stringer tapes of the jacket attachment 46" and the jacket closure 18 are shaped similarly so that these stringer tapes can be selectively attached to each other using the jacket and attachment sliders 60 and 64.

Figure 7:
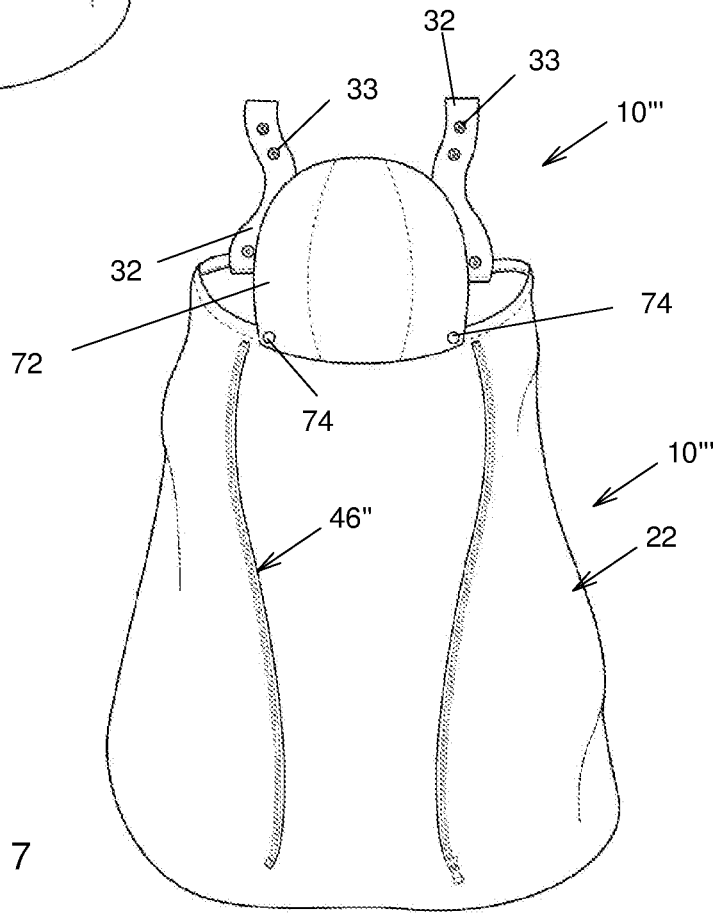
FIG. 7, in a front elevation view, illustrates a carrier cover in accordance with yet another alternative embodiment of the present invention.

Referring to FIG. 7, in some embodiments, the carrier cover 10'" may include a hood portion 72 extending from the body 22'" for covering a head of the baby in use. The hood portion 72 may be removably attachable to the body 22, for example using snap buttons 74, or may be permanently fixed thereto, through stitches or an adhesive, among other possibilities (not shown in the drawings).

Referring to FIG. 2, in some embodiments, the carrier cover 10 further includes a waist strap 76 extending from the body 22 between the two body side portions 24 and 26 for selectively encircling a waist of the intended user (not shown in FIG. 2). The waist strap 76 is for example stretchable and secured to the body 22 using snap buttons 78. The waist strap 76 may include a plurality of longitudinally spaced apart snap button halves, each securable to the same location on the body 22, to provide adjustability to the size of the waist of the intended user. The waist strap 76 is either stretchable or non-stretchable. In some embodiments, the waist strap 76 and associated snap buttons 78 are omitted from the carrier cover 10. The waist strap 76, when used, helps in maintaining the carrier cover 10 against the intended user 20 to reduce the possibility that air enters the carrier cover 10 from below and the sides.

Figure 4:
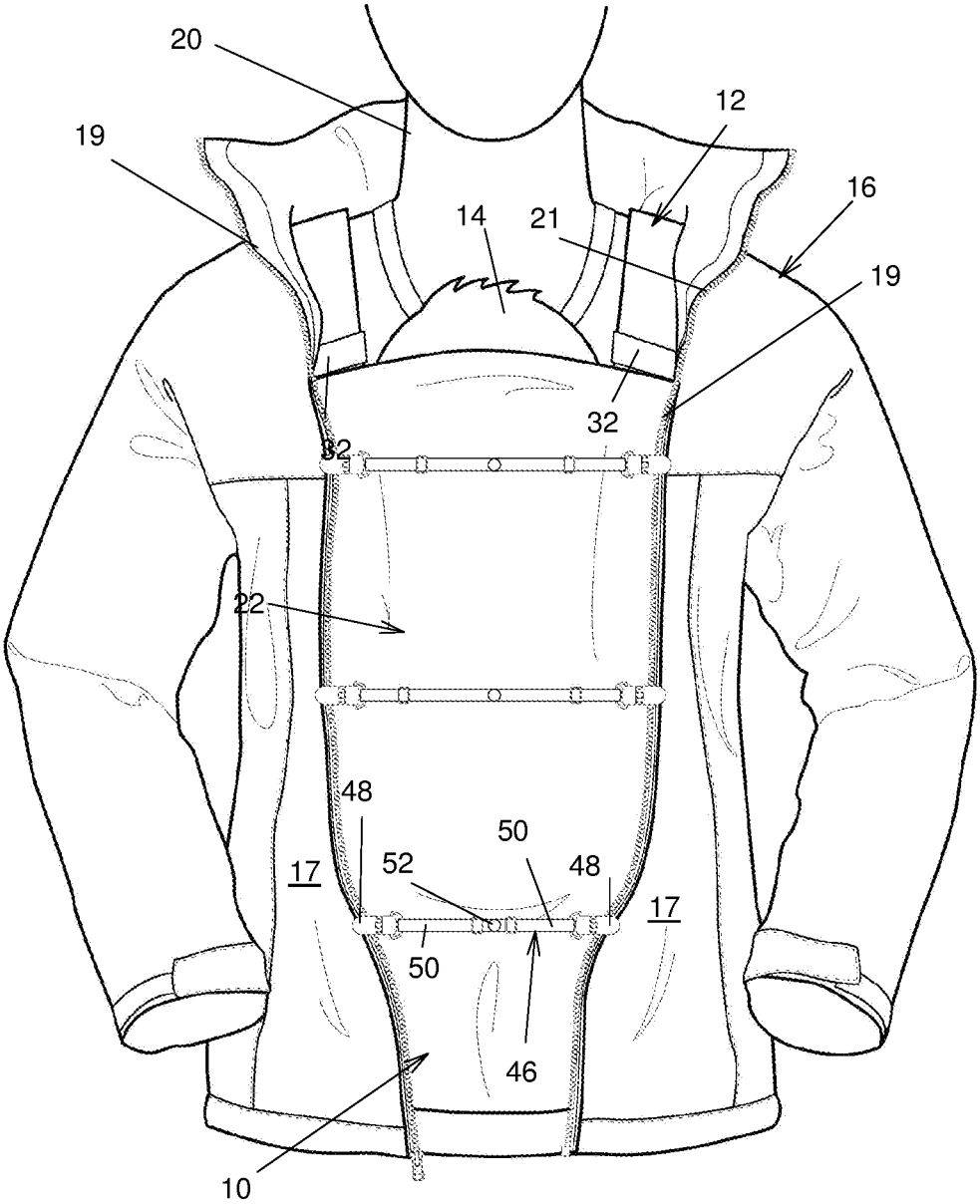
FIG. 4, in a front elevation view, illustrates the carrier cover of FIGS. 1 to 3, the carrier cover having secured thereto both front panels of the jacket worn by the intended user.

An example of how the carrier cover 10 may be used is as follows. First, the baby carrier 12 and baby 14 first secured to the intended user 20 in a conventional manner. The baby 14 is thus carried adjacent to a chest of the intended user 20 in the baby carrier 12. Then, as seen in FIG. 1, the carrier cover 10 is positioned over the baby carrier 12 and secured thereto using the mounting elements. It should be noted that in alternative embodiments, the carrier cover 10 includes a mounting element in the form of a neck strap or other similar mounting element and that in such embodiments, the carrier cover 10 is mounted to the intended user 20 through this neck strap, and is not necessarily mounted to the baby carrier 12. Once the baby 14 is suitably protected, the intended user 20 puts on the jacket 16. The jacket 16 is thus worn over the baby carrier 12 and the baby 14, but instead of using the jacket closure 18 to close the jacket 16, the intended user attaches the jacket attachment 46 to the jacket 16 at the jacket front portion free edges 19, as seen in FIG. 4. Thus, each jacket front portion 17 is secured at the jacket front portion free edge 19 to the carrier cover 10 so that carrier cover 10 closes the jacket gap 21 and the intended user 20 and the baby 14 are protected from the elements jointly by the jacket 16 and the carrier cover 10. It should be noted that the jacket 16 may be worn as soon as the baby carrier 12 is worn, and that one does not have to wait until the baby 14 and carrier cover 10 are in position to put the jacket 16 on. If for any reason the intended user 20 wishes to evacuate heat, some of the jacket attachments 46 can be detached from the jacket 16, for example all jacket attachments 46 from one or both sides of the carrier cover 12, the former being seen in FIG. 3. Although cold air is allowed to enter in the jacket 16 so that the intended user 20 is exposed to ambient air, the baby 14 remains protected from this ambient air by the carrier cover 10. In some embodiments, the carrier cover 10 could be used without the intended user 20 wearing the jacket 16.

In some embodiments, the body 22 has a uniform structure over the body front, side and bottom portions 24, 26, 28 and 30. However, in some embodiments, the body front portion 28 is made of or covered by a waterproof and/or windproof material, as it is exposed to rain, snow and wind in use and must therefore provide protection against these meteorological phenomena. In these embodiments, typically, the body side portions 24 and 26, and in some embodiments also the body bottom portion 30, are made of a warm but breathable material, such as polar fleece.

Although the present invention has been described hereinabove by way of exemplary embodiments thereof, it will be readily appreciated that many modifications are possible in the exemplary embodiments without materially departing from the novel teachings and advantages of this invention. Accordingly, the scope of the claims should not be limited by the exemplary embodiments, but should be given the broadest interpretation consistent with the description as a whole.

What is claimed is:

1. A carrier cover securable to a baby carrier to at least partially cover a baby carried in the baby carrier with the baby carrier worn by an intended user, the carrier cover being usable in combination with a jacket worn by the intended user, the jacket having a pair of jacket front portions defining each a respective jacket front portion free edge, the jacket front portion free edges facing each other and defining a jacket gap therebetween, the carrier cover comprising:

a body defining two opposed body side portions and a body front portion extending therebetween, the body front and side portions covering respectively front facing and side facing portions of the baby when the carrier cover is operatively secured to the baby carrier;

at least one mounting element for mounting the body to the baby carrier; and at least one jacket attachment extending from the body and attachable to at least one of the jacket front portions at the jacket front portion free edge;

wherein the carrier cover is directly mounted to the baby carrier when the carrier cover is operatively secured to the baby carrier.

2. The carrier cover as defined in claim 1, wherein the jacket includes a jacket closure at the jacket front portion free edge, the jacket attachment being attachable to the jacket closure.

3. The carrier cover as defined in claim 2, wherein the jacket closure is a jacket slide fastener including a pair of jacket slide fastener halves each mounted at a respective one of the jacket front portion free edges and a jacket slider operable for selectively engaging the jacket slide fastener halves to each other and disengaging the jacket slide fastener halves from each other, the jacket attachment including an attachment slide fastener half operable for engaging one of the jacket slide fastener halves.

4. The carrier cover as defined in claim 2, wherein the jacket closure is a jacket slide fastener including a pair of jacket slide fastener halves each mounted at a respective one of the jacket front portion free edges and a jacket slider operable for selectively engaging the jacket slide fastener halves to each other and disengaging the jacket slide fastener halves from each other, the jacket attachment including a pair of elongated attachment slide fastener halves secured to the body laterally spaced apart from each other and an attachment slider slidable along one of the attachment slide fastener halves, each attachment slide fastener half being attachable to a respective one of the jacket slide fastener halves using one of the jacket and attachment sliders.

5. The carrier cover as defined in claim 4, wherein the attachment slide fastener halves each include opposed attachment half top and bottom portions and an attachment half intermediate portion therebetween, the attachment half top portions being spaced apart from each other by a larger distance than the attachment half bottom portions.

6. The carrier cover as defined in claim 1, wherein the jacket attachment includes a clip secured to the body, the clip being clippable to the jacket at one of the jacket front portion free edges.

7. The carrier cover as defined in claim 6, wherein a substantially elongated clip mounting element extends between the clip and the body.

8. The carrier cover as defined in claim 7, wherein the clip mounting element is resiliently stretchable for allowing variations in a distance between the clip and the body when the clip mounting element is stretched.

9. The carrier cover as defined in claim 7, wherein the clip mounting element is selectively length adjustable.

10. The carrier cover as defined in claim 1, wherein the body defines a body peripheral edge, the mounting element including a drawstring operatively coupled to the body for selectively drawing at least part of the body at the body peripheral edge.

11. The carrier cover as defined in claim 10, wherein the drawstring is mounted inside a hem so that the hem is slidable relative thereto along a major portion thereof, the drawstring having two attachment locations secured to the body so that the two attachment locations are fixed relative to the hem, the hem defining a hem aperture through which part of the drawstring protrudes, the mounting element further including a cord lock for selectively locking a length of the drawstring protruding from the drawstring aperture.

12. The carrier cover as defined in claim 1, wherein the baby carrier includes a shoulder strap, the mounting element including a mounting strap securable to one of the shoulder straps.

13. The carrier cover as defined in claim 1, further comprising a hood portion extending from the body for covering a head of the baby.

14. The carrier cover as defined in claim 13, wherein the hood portion is removably attachable to the body.

15. The carrier cover as defined in claim 1, further comprising a waist strap extending from the body for selectively encircling a waist of the intended user.

16. The carrier cover as defined in claim 1, wherein the body defines a body bottom portion covering a bottom facing portion of the baby when the carrier cover is operatively secured to the baby carrier.

17. The carrier cover as defined in claim 1, wherein the jacket attachment is selectively securable to the body at a selected one of at least two different locations on the body.

18. In combination, a carrier cover and a baby carrier, the carrier cover being positioned over the baby carrier so as to least partially cover a baby carried in the baby carrier with the baby carrier worn by an intended user, the carrier cover being usable in combination with a jacket worn by the intended user, the jacket having a pair of jacket front portions defining each a respective jacket front portion free edge, the jacket front portion free edges facing each other and defining a jacket gap therebetween, the carrier cover comprising:

a body defining two opposed body side portions and a body front portion extending therebetween, the body front and side portions covering respectively front facing and side facing portions of the baby when the carrier cover is operatively secured to the baby carrier;

at least one mounting element for mounting the body to the baby carrier; and at least one jacket attachment extending from the body and attachable to at least one of the jacket front portions at the jacket front portion free edge;

wherein the carrier cover is directly mounted to the baby carrier.

19. A method performed by an intended user wearing a jacket and a baby carrier in which a baby is carried adjacent a chest of the intended user, the jacket being worn over the baby carrier and the baby, the jacket having a pair of jacket front portions defining each a respective jacket front portion free edge, the jacket front portion free edges facing each other, the method using a carrier cover, the method comprising:

securing the carrier cover over the baby carrier by mounting the carrier cover directly to the baby carrier; and securing each jacket front portion at the jacket front portion free edge to the carrier cover so that carrier cover closes the jacket and the intended user and the baby are protected from the elements jointly by the jacket and the carrier cover.

20. The method as defined in claim 19, further comprising detaching at least one of the jacket front portions from the carrier cover so that the intended user is exposed to ambient air while the baby is protected from ambient air by the carrier cover.

21. The combination as defined in claim 18, wherein the baby carrier is enclosed in the carrier cover, except for a top opening allowing air to reach a baby carried in the baby carrier for breathing and a rear gap which faces an intended user wearing the baby carrier and is obstructed by the intended user in use, whereby the baby is protected from ambient air in use with the carrier cover detached from the jacket but mounted to the baby carrier.

22. The combination as defined in claim 21, wherein the at least one mounting element includes a drawstring operatively coupled to the body for selectively drawing at least part of the body at the body peripheral edge along peripheral edge side and bottom portions of the body peripheral edge.

* * * * *